United States Patent [19]

McFadden

[11] Patent Number: 4,487,439

[45] Date of Patent: Dec. 11, 1984

[54] MAGNETIC SHEAR LOCKING METHODS AND APPARATUS

[75] Inventor: William C. McFadden, La Canada, Calif.

[73] Assignee: Dynametric, Inc., Pasadena, Calif.

[21] Appl. No.: 315,686

[22] Filed: Oct. 27, 1981

[51] Int. Cl.[3] ..... E05C 17/56

[52] U.S. Cl. ..... 292/251.5; 292/74; 292/144

[58] Field of Search ..... 292/251.5, 201, 74, 292/144

[56] References Cited

U.S. PATENT DOCUMENTS

| | | | |
|---|---|---|---|
| 2,472,397 | 6/1949 | Bennett | 292/251.5 |
| 2,497,697 | 2/1950 | Smith | 292/251.5 X |
| 2,673,755 | 3/1954 | Asp | 292/251.5 X |
| 2,690,349 | 9/1954 | Testor | 292/251.5 |
| 2,812,965 | 11/1957 | Horway | 292/251.5 |
| 3,537,719 | 11/1970 | Gattfried | 292/251.5 X |
| 4,287,512 | 9/1981 | Combs | 340/542 |

FOREIGN PATENT DOCUMENTS

| | | | |
|---|---|---|---|
| 461157 | 1/1951 | Italy | 292/251.5 |
| 351186 | 2/1961 | Switzerland | 292/251.5 |

*Primary Examiner*—Richard E. Moore

*Attorney, Agent, or Firm*—Benoit Law Corporation

[57] ABSTRACT

Shearing motion between first and second parts of an electromagnetic lock for maintaining a door shut are translated into a force tending to lift the second part away from the first part of the energized lock, and the shearing motion is countered by countering the latter force with the magnetic attraction between the first and second parts of the energized electromagnetic lock. The mechanical friction between the mutually attracted first and second lock parts is added to the full holding force between these parts, so that the holding power of the lock considerably exceeds the holding power generated by the magnetic field between the first and second parts alone.

61 Claims, 9 Drawing Figures

MAGNETIC SHEAR LOCKING METHODS AND APPARATUS

BACKGROUND OF THE INVENTION

The subject invention relates generally to systems for preventing removal of or relative motion between parts, to methods and apparatus for operating magnetic locking assemblies, to magnetic locks and similar fastening devices, and to various door structures including magnetic locks.

Magnetic locks have become known in which a keeper or striker plate is magnetically attracted to a pole face of an electromagnetic assembly. This type of electromagnetic lock generally works well when the striker plate and electromagnetic assembly are mounted on or connected to a door and doorframe, respectively, or to similar structure, in such a manner that a forced opening of the door or similar structure would urge the striker plate to separate itself against the force of the magnetic attraction in a direction parallel to the direction of the magnetic field or perpendicularly to the pole face of the electromagnetic lock.

In practice, this limits the utility of the discussed type of magnetic lock, since there are many situations in which the preferable or inevitable arrangement would have to be such that there occurs a shearing motion between the striker plate and the pole face or electromagnetic assembly of the lock, when attempts are made to open the locked door or other structure forcibly.

In cases of the latter type, existing electromagentic locks of the above mentioned kind have not been doing well, inasmuch as the retention force between the striker plate and electromagnetic assembly at the pole face is then determined practically by the friction between the latter two parts, rather than effectively by the strength of the magnetic field with which the electromagnetic assembly attracts the striker plate. In other words, the only significant force developed in the transverse direction parallel to the pole face is that of mechanical friction which is usually less than 25 percent of the magnetic attraction holding force perpendicular to the pole face.

In consequence, many swinging or lifting door installations and similar arrangements could not use the above mentioned type of lock safely. Also, mechanically actuated thrusting bolts frequently had to be employed in magnetic locks for a safe locking operation. This, of course, caused additional expense and complexity, and required that a fairly exact correspondence between the position of the thrusting bolt in one lock component and the bolt-receiving cavity in the other lock component be always maintained and consistently reproducible, even over a long period of time and even with door structures that may be subject to certain manufacturing and installation tolerances or to settling over prolonged periods of use.

Another drawback of bolt-type electromagnetic locks is that the bolt is subject to sticking upon deenergization of the lock, whereby people sometimes have been unable to leave a room controlled by such magnetic locks.

SUMMARY OF THE INVENTION

It is a general object of this invention to overcome the disadvantages and meet the needs expressed or implicit in the above description of the background of the invention or in other parts hereof.

It is a germane object of this invention to provide improved methods of operating an electromagnetic lock and improved electromagnetic locks.

It is a related object of this invention to provide improved electromagnetic locking systems in which distinct parts of an electromagnetic lock are arranged for shearing relative motion parallel to a magnetic pole face.

It is a similar object of this invention to provide improved electromagnetic locking systems in which distinct parts of an electromagnetic lock are, respectively, mounted on stationary and movable parts of a door structure and are arranged for shearing relative motion upon unauthorized attempts to open the door structure.

It is also an object of this invention to improve the performance or holding power of electromagnetic shear locks.

It is a related object of this invention to provide improved electromagnetic locking systems for, and to provide improved, swinging, sliding, lifting and similar door structures.

Other objects of this invention will become apparent in the further course of this disclosure.

From a first aspect thereof, the subject invention resides in a method of operating an electromagnetic lock including a first part having a magnetic pole face and a second part magnetically attractable to said pole face arranged for shearing relative motion parallel to said pole face. The invention according to this aspect resides, more specifically, in the improvement comprising, in combination, the steps of exerting magnetic attraction with said first part on said second part by means of a magnetic field generating a predetermined holding power between said first and second parts, providing with the aid of non-magnetic magnetic material a surface inclined relative to said pole face and translating shearing motion between said first and second parts with the aid of said inclined surface into a lifting force tending to lift said second part away from said first part, and providing between said first and second parts a holding power exceeding said predetermined holding power by countering said lifting force with said magnetic attraction and a mechanical friction between said first and second parts upon attempted shearing motion therebetween.

From another aspect thereof, the subject invention resides in a method of operating an electromagnetic lock including an energizable first part having a magnetic pole face and a second part magnetically attractable to said pole face arranged for shearing relative motion parallel to said pole face. The invention according to this aspect resides, more specifically, in the improvement comprising, in combination, the steps of providing in one of said first and second parts a protrusion toward the other of said first and second parts, providing in said other part a recess corresponding to said protrusion, initially spacing said first and second parts away from each other by a distance exceeding said protrusion to permit relative sideways motion between said first and second parts, and interfitting said protrusion and corresponding recess by magnetic attraction upon energization of said first part and movement of said first and second parts toward each other constituting said protrusion as a non-magnetic separation between said first and second parts so as to enable said second part to cross said first part even after energization of said first part until said protrusion and corresponding recess are interfitted.

From a further aspect thereof, the subject invention resides in a method of operating an electromagnetic lock for a door structure having a stationary part defining a door opening and a movable part for selectively opening and closing said door opening with said electromagnetic lock including a first part having a magnetic pole face and a second part magnetically attractable to said pole face. The invention according to this aspect resides, more specifically, in the improvement comprising, in combination, the steps of providing with the aid of non-magnetic material a surface inclined relative to said pole face, mounting one of said first and second parts of said lock on one of said stationary and movable parts of said door structure, mounting the other of said first and second parts of said lock on the other of said stationary and movable parts of said door structure for shearing relative motion between said first and second parts of said lock parallel to said pole face upon movement of said movable part, closing said door opening with said movable part of the door structure, locking said movable part of the door structure in said door opening by exerting magnetic attraction with said first part on said second part of the lock by means of a magnetic field generating a predetermined holding power between said first and second parts, permitting an attempt to move said movable part of the door structure while said first part exerts magnetic attraction on said second part of the lock and translating shearing motion between said first and second parts of the lock with the aid of said inclined surface into a lifting force tending to lift said second part away from said first part of the lock, and resisting said attempt to move said movable part of the door structure by providing between said first and second parts a holding power exceeding said predetermined holding power by countering said shearing motion with an opposition of said lifting force by said magnetic attraction and a mechanical friction between said first and second parts upon attempted shearing motion therebetween.

From a further aspect thereof, the subject invention resides in a method of operating an electromagnetic lock for a door structure having a stationary part defining a door opening and a movable part for selectively opening and closing said door opening, with said electromagnetic lock including an energizable first part having a magnetic pole face and a second part magnetically attractable to said pole face. The invention according to this aspect resides, more specifically, in the improvement comprising, in combination, the steps of providing in one of said first and second parts of the lock a protrusion toward the other of said first and second parts, providing in said other part of the lock a recess corresponding to said protrusion, mounting one of said first and second parts of the lock on one of said stationary and movable parts of the door structure, mounting the other of said first and second parts of the lock on the other of said stationary and movable parts of the door structure for shearing relative motion between said first and second parts of the lock parallel to said pole face upon movement of said movable part of the door structure, initially spacing said first and second parts of the lock away from each other by a distance exceeding said protrusion to permit movement of said movable part of the door structure, and locking said movable part of the door structure in said door opening by interfitting said protrusion and corresponding recess by magnetic attraction upon energization of said first part and movement of said first and second parts toward each other, and constituting said protrusion as a non-magnetic separation between said first and second parts so as to enable said second part to cross said first part during closing of said door opening by said movable part even after energization of said first part until said protrusion and corresponding recess are interfitted.

From a further aspect thereof, the subject invention resides in an electromagnetic lock including a first part having a magnetic pole face by means of a magnetic field generating a predetermined holding power between said first and second parts, said first and second parts being and a second part magnetically attractable to said pole face arranged for shearing relative motion parallel to said pole face. The invention according to this aspect resides, more specifically, in the improvement comprising, in combination, non-magnetic means coupled to said first and second parts and having a surface inclined relative to said pole face for translating shearing motion between said first second parts into a lifting force tending to lift said second part away from said first part, and means for providing between said first and second parts a holding power exceeding said predetermined holding power, including means connected to said first part for magnetically attracting said first and second parts to each other in opposition to said lifting force and for countering said lifting force with said magnetic attraction and a mechanical friction between said first and second parts upon attempted shearing motion therebetween.

From a further aspect thereof, the subject invention resides in an electromagnetic lock including an energizable first part having a magnetic pole face and a second part magnetically attractable to said pole face arranged for shearing relative motion parallel to said pole face. The invention according to this aspect resides, more specifically, in the improvement comprising, in combination, a protrusion in one of said first and second parts toward the other of said first and second parts, a recess in said other part corresponding to said protrusion, means for initially spacing said first and second parts away from each other by a distance exceeding said protrusion to permit relative sideways motion between said first and second parts, and means for interfitting said protrusion and corresponding recess by magnetic attraction upon energization of said first part and movement of said first and second parts toward each other, said protrusion being of non-magnetic material for enabling said second part to cross said first part even after energization of said first part, until said protrusion and corresponding recess are interfitted.

From a further aspect thereof, the subject invention resides in an electromagnetic lock for a door structure having a stationary part defining a door opening and a movable part for selectively opening and closing said door opening, with said electromagnetic lock including a first part having a magnetic pole face and a second part magnetically attractable to said pole face by means of a magnetic field generating a predetermined holding power between said first and second parts, said first and second parts being arranged for shearing relative motion parallel to said pole face. The invention according to this aspect resides, more specifically, in the improvement comprising, in combination, means for mounting one of said first and second parts of said lock on one of said stationary and movable parts of said door structure, means for mounting the other of said first and second parts of said lock on the other of said stationary and movable parts of said door structure for shearing relative motion between said first and second parts of said lock parallel to said pole face upon movement of said movable part, non-magnetic means coupled to said first and second parts of the lock and having a surface inclined relative to said pole face for translating shearing motion between said first and second parts of the lock into a lifting force tending to lift said second part away from said first part of the lock, and means for providing between said first and second parts a holding power exceeding said predetermined holding power, including means connected to said first part for magnetically attracting said first and second parts to each other in opposition to said lifting force and for countering said lifting force with said magnetic attraction and a mechanical friction between said first and second parts upon attempted shearing motion therebetween.

From a further aspect thereof, the subject invention resides in an electromagnetic lock for a door structure having a stationary part defining a door opening and a movable part for selectively opening and closing said door opening, with said electromagnetic lock including an energizable first part having a magnetic pole face and a second part magnetically attractable to said pole face. The invention according to this aspect resides, more specifically, in the improvement comprising, in combination, a protrusion in one of said first and second parts of the lock toward the other of said first and second parts, a recess in said other part of the lock corresponding to said protrusion, means for mounting one of said first and second parts of the lock on one of said stationary and movable parts of the door structure, means for mounting the other of said first and second parts of the lock on the other of said stationary and movable parts of the door structure for shearing relative motion between said first and second parts of the lock parallel to said pole face upon movement of said movable part of the door structure, means for initially spacing said first and second parts of the lock away from each other by a distance exceeding said protrusion to permit movement of said movable part of the door structure, and means for locking said movable part of the door structure in said door opening by interfitting said protrusion and corresponding recess by magnetic attraction upon energization of said first part and movement of said first and second parts toward each other.

BRIEF DESCRIPTION OF THE DRAWINGS

The subject invention will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 2:
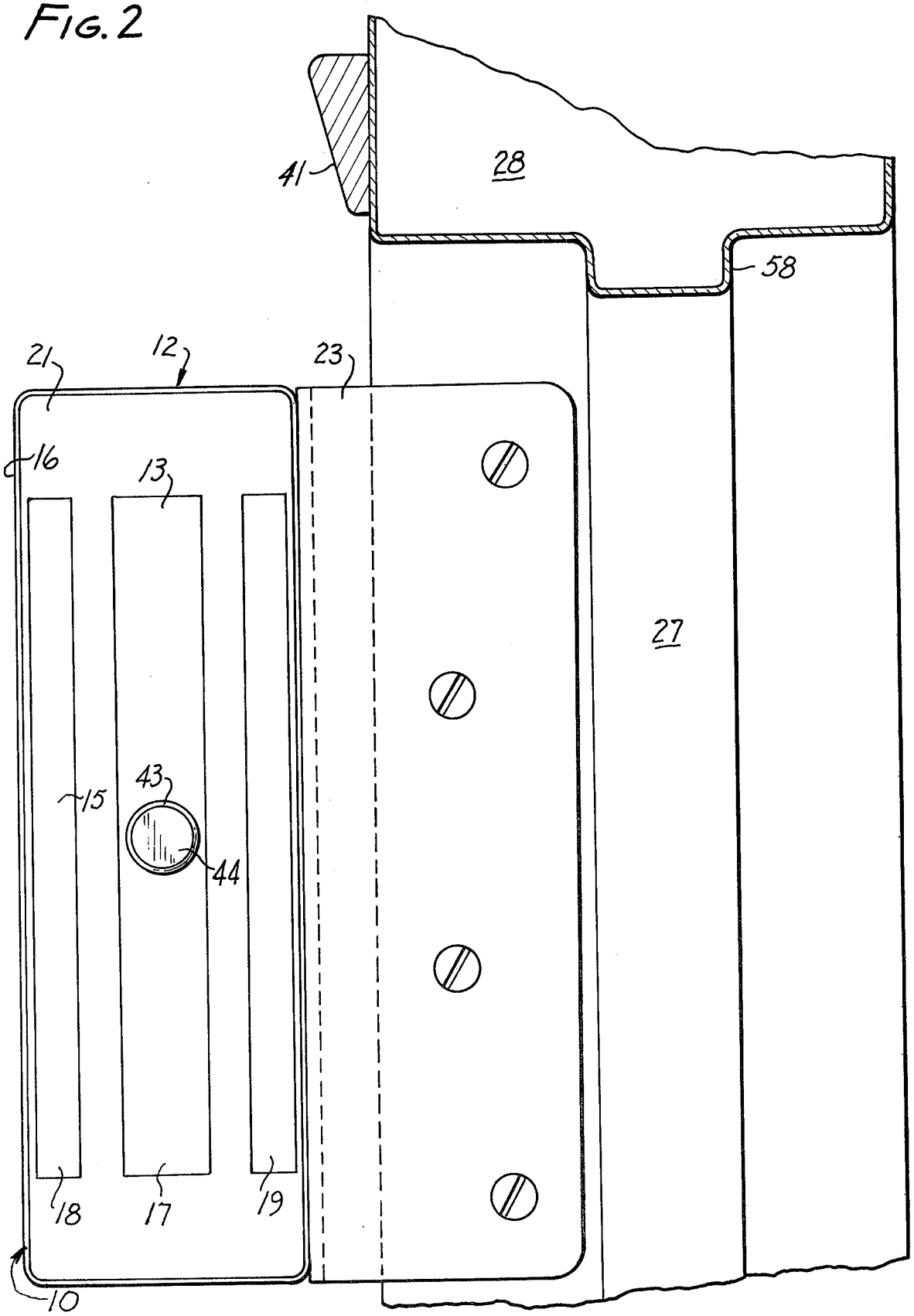
FIG. 2 is a partial side view of the stationary part of the electromagnetic lock and door structure shown in FIG. 1.

The e1ectromagnetic locks 10 herein shown include a first part or electromagnetic assembly 12 having a magnetic pole face 13, such as seen in FIG. 2, and a second part, such as a keeper or striker plate 14 being of a material that is magnetically attractable to the pole face 13. In the illustrated preferred embodiments of the invention, the second part or striker plate 14 is arranged for shearing relative motion parallel to the pole face 13.

The magnetic lock assembly 12 may also be termed a magnetic armature and may include a magnetizable core 15 having the pole face 13 and being located in a magnetic shielding box 16. Reference may in this respect be had to U.S. Pat. No. 4,287,512, by C. Marlon Combs, issued Sept. 1, 1981 to the assignee of the entire interest hereof, and herewith incorporated by reference herein.

As apparent from that prior patent, the core 15 may have an electrical winding (not shown herein) for magnetizing same, and may be of an E-shaped type providing the pole face 13 which, as shown in FIG. 2, may be composed of three pole face parts 17, 18 and 19. The core 13 may be of a laminated type and may be provided with a Hall-effect or other flux monitoring device as disclosed, for instance, in the above mentioned incorporated prior patent. If desired, the core 15 and its electromagnetic winding may be potted in the shielding box 16 with a cast epoxy resin or other suitable potting compound 21. The box 16 is preferably of magnetic material so as to perform a magnetic shielding function with respect to the core 13 and its electromagnetic winding.

The electromagnetic assembly 10 has or is affixed to a laterally projecting mounting bracket 23 which, for instance, may be in the form of an angle bracket.

The striker plate is part of a striker plate assembly 24 which includes a mounting bracket 25 which, also by way of example, may be in the form of an angle bracket.

The drawings also show a door structure 27 having a stationary part or doorframe 28 defining a door opening 29 and a movable part or door 31 for selectively opening and closing the door opening. One of the first and second parts 12 and 14 of the lock 10 is mounted on one of the stationary and movable parts 28 and 31 of the door structure 27. In principle, the electromagnetic lock assembly 12 could be mounted on either the door-frame 28 or the door 31, while the striker plate 14 could then be mounted on the other of the doorframe 28 and door 31. In the illustrated preferred embodiment of the subject invention, however, the bracket 23 mounts the locking assembly 12 on or at the doorframe 28, while the mounting bracket 25 mounts the striker plate 14 on or at the movable door 31.

In either case, the first and second parts 12 and 14 of the lock 10 are mounted for shearing relative motion between such first and second parts 12 and 14 of the lock parallel to the pole face 13, upon movement of the movable part or door 31 of the door structure 27.

In practice, the door opening 29 is closed with the movable part 31 of the door structure. In order to lock the movable part or door 31 in the door opening 29, magnetic attraction is exerted with the first part 12 on the second part 14 of the electromagnetic lock assembly 10.

To this end, the electric coil or winding on the magnetic core 15 is electrically energized, so that a magnetic field is generated which emanates from the pole face 13 of the magnetic lock. Various equipment and circuitry are known for energizing coils or windings of magnetic locks with electrical current. By way of example, reference may in this respect be had to the electric power supply and energizing circuitry disclosed in the above mentioned prior patent incorporated by reference herein.

The magnetic field emanating from the core 13 attracts the magnetizable striker plate 14 to the pole face of the magnetic lock assembly 10 or part 12. In this respect, the striker plate 14 may be mounted on its mounting bracket 25 via a coupling 33 permitting some mobility or flexibility of the striker plate 14 relative to the bracket 25 and, thereby, relative to the door 31. For instance, the coupling 33 may have a mounting bolt 34 which is threaded in a nut 35 so as to be effectively retained therein. The nut 35 is attached or affixed to the mounting bracket 25. The bolt 35 extends loosely through a bore 36 in the striker plate 14, and has a conical head 37 sitting in a corresponding conical counterbore 38, whereby the bolt 34 with its head 37 somewhat loosely retains the striker plate 14 adjacent the mounting bracket 25 and, in the closed position of the door 31, adjacent the magnetic core assembly 12.

The coupling 33 also has an elastic part, including several washers 39, at least one of which may be of an elastomeric type, so as to permit a certain tilting motion of the striker plate 14 relative to its mounting bracket 25.

In this manner, the striker plate 14 is not only attracted to the core 15 by its magnetic field, but is also optimally adapted in position to its pole face 13.

Figure 3:
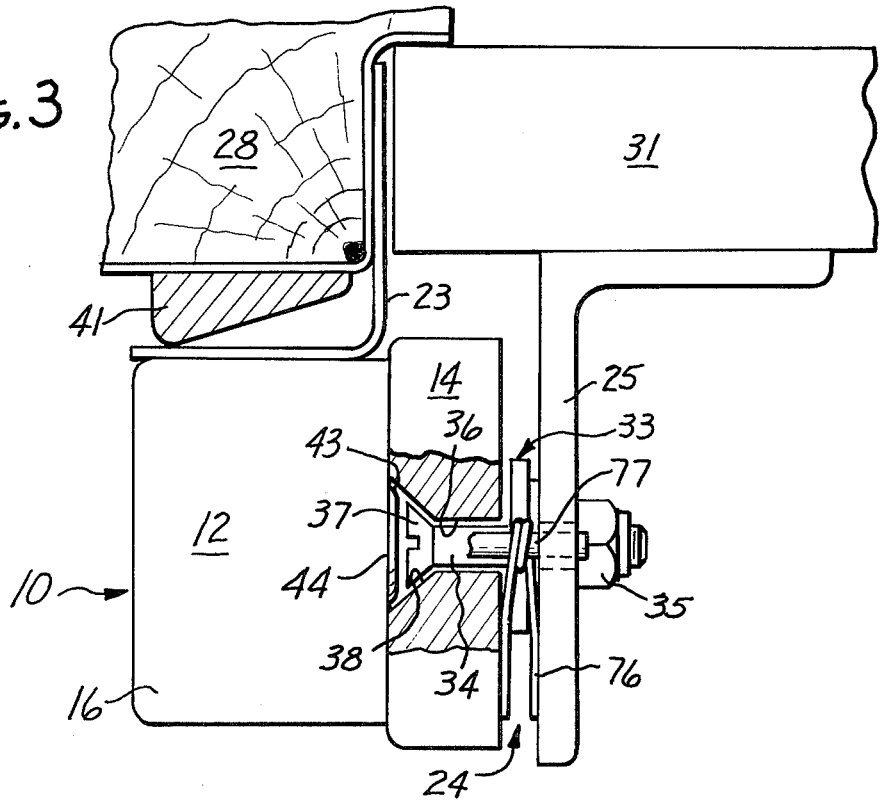
FIG. 3 is a partial top view of the electromagnetic lock and door structure shown in FIG. 1.

As seen in FIG. 3, the bracket 23 may be so arranged or affixed as to accommodate moldings 41 and similar parts. In this, as well as in the other instances herein specifically disclosed, the magnetic lock parts 12 and 14 are arranged for shearing motion relative to each other when the door 31 is opened or is attempted to be opened while the magnetic lock is energized. In practice, such shearing motion arrangement has not heretofore appeared desirable from a locking point of view, since the holding power attainable with magnetic lock parts in shearing motion parallel to the pole face 13 has been limited to a fraction of the holding power perpendicularly to the pole face. In fact, the holding power for shearing motion has been practically limited to the attainable friction between the striker plate 14 and magnetic core 15 at the pole face 13. This, in practical terms, limited the shearing motion holding power less than 25% of the lifting motion holding power perpendicular to the pole face 13. face 13.

On the other hand, a shearing motion type of arrangement would be the only practical approach in many situations and for many purposes, including swinging doors, particularly those of the double-acting type, sliding doors and lifting doors. However, because of the conventional holding power limitations, the design advantages which shearing motion arrangements would have brought to electromagnetic locks of the pole face and striker plate type went substantially unused in the face of an increasing demand for novel arrangements and more generally applicable practical electromagnetic locking devices.

The subject invention overcomes the prior-art stalemate and satisfies the latter need by translating shearing motion between the first and second parts 12 and 14 into a lifting force tending to lift the second part 14 away from the first part 12. The subject invention then counters the shearing motion by countering the mentioned lifting force with the magnetic attraction exerted by the core 15 at the pole face 13.

The expression "lifting force" as herein employed is not intended to be limited to a force which, in effect, would lift the striker plate 14 away from the electromagnetic assembly 12 against the pull of gravity. Rather, the expression "lifting force" is intended to be broad enough to extend to any force acting perpendicularly or at an angle to the pole face 13 in an effort to separate the striker plate or second part 14 from the electromagnetic assembly 12, core 15 or first part 12 of the electromagnetic lock 10.

In that sense, a lifting force may thus act against the pull of gravity, with the pull of gravity or sideways relative to the pull of gravity, for instance.

According to a preferred embodiment thereof, the subject invention provides a surface, such as the surface 43 shown in the drawings, which is inclined relative to the pole face 13. The invention according to the illustrated preferred embodiment then exerts a force on the inclined surface 43 in response to relative shearing motion between magnetic lock parts 12 and 14, and translates such exerted force with the inclined surface 43 into the mentioned lifting force, tending to move, for instance, the second lock part or striker plate 14 away from the first lock part or electromagnetic assembly 12.

The inclined surface 43 may extend transversely to the direction of shearing motion between lock parts 12 and 14. For omnidirectional action and manufacturing efficiency, the inclined force translating surface 43 may extend circularly or annularly as shown in the drawings or may otherwise be closed in itself.

Figure 5:
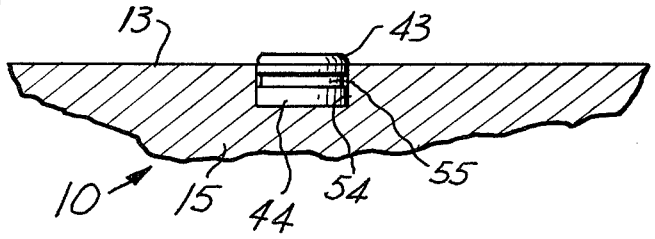
FIG. 5 is a detailed view of an electromagnetic lock assembly employed in the electromagnetic lock and door structure of FIGS. 1 to 4.

In the illustrated preferred embodiments of the subject invention, the annular inclined surface 43 has the form of a bevel or chamfer on a circular disc 44 projecting from the pole face 13 in the direction of the second lock part or striker plate 14. As seen in FIG. 5, the disc or button 44 may be anchored in a corresponding bore 54 in the core 15 at the pole face 13. The disc 44 may have a circumferential groove 55 for receiving an adhesive or similar agency assisting the anchoring of the disc in the core 15. As seen in FIGS. 1, 2, 3, 5, 6, 7, 8 and 9, the protrusion or disc 44 has a flat top.

Figure 1:
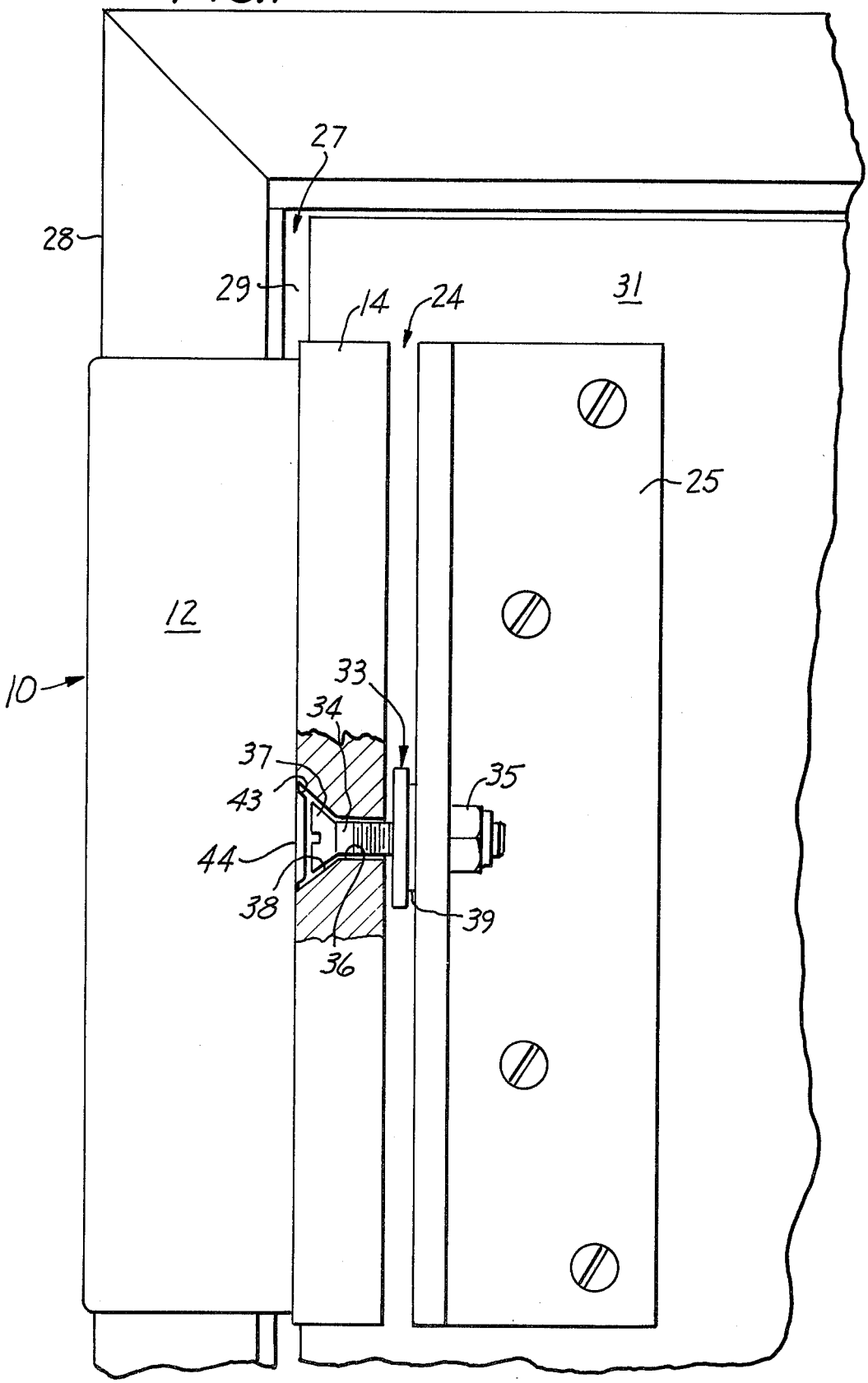
FIG. 1 is a partial elevation of an electromagnetic lock and door structure according to a preferred embodiment of the subject invention.

The disc 44 which presents the inclined surface 43 preferably is made of stainless steel or another non-magnetic material whereby sticking of the striker plate is advantageously avoided and whereby a considerable nonmagnetic gap, corresponding to the height of the projecting disc 44 or inclined surface 43 above the pole face 13, is provided and maintained between the lock parts 12 and 14, until the part 14 is seated with its tapered bore 38 at the inclined surface 43 as shown, for instance, in FIGS. 1 and 3.

With the electromagnetic assembly 12 energized to attract the striker plate 14 to its pole face 13, and with the striker plate 14 properly seated so as to encompass with its tapered bore 38 the inclined surface 43 of the projecting disc 44, transverse or shearing motion of the striker plate 14 relative to the electromagnetic assembly 12 will translate itself at such inclined surface automatically into a lifting force between the lock parts 12 and 14, tending to separate or lift the striker plate 14 away from the pole face 13.

In particular, the illustrated lock and door structure assemblies permit attempts to move the movable part 31 of the door structure while the first part 12 exerts magnetic attraction on the second part 14 of the electromagnetic lock 10, and translates the shearing motion between the first and second parts 12 and 14 of the lock resulting from such attempts to move the door 13 into a lifting force tending to lift the second part 14 away from the first part 12 of the lock 10.

If desired or necessary, a hardened insert defining the tapered hole 38 may be used in the striker plate 14 to avoid wear from the raised disc 44.

The subject invention counters shearing motion between the first and second lock parts 12 and 14 by countering the mentioned lifting force with the magnetic attraction between these first and second parts 12 and 14 of the electromagnetic lock 10. In terms of the illustrated preferred embodiment thereof, the subject invention resists attempts to move the door or movable part 31 of the door structure by countering the shearing motion with an opposition of the mentioned lifting force by the magnetic attraction between the energized lock parts 12 and 14.

The inclined surface 43 in effect resolves a transverse or shearing motion between the lock parts 12 and 14 into a lifting force extending preferably perpendicularly to the pole face 13, where it can be effectively countered by the full holding force of the electromagnetic lock assembly. Stated differently, the inclined surface 43 or equivalent force translating agency resolves the perpendicular holding force of the electromagnetic lock assembly to the transverse direction, thus providing the full electromagnetic holding force in the direction of shearing motion between the lock parts 12 and 14.

In practice, the electromagnetic locks herein disclosed have an even greater holding power than merely the holding force between the lock parts 12 and 14. In particular, since these lock parts are subjected to a relative shearing motion upon attempts to open the door 13 while the magnetic lock is energized, the mechanical friction between the mutually attracted first and second lock parts 12 and 14 will add itself to the translated full holding force between such parts 12 and 14, whereby the full holding power of the electromagnetic shear locks according to the subject invention will considerably exceed the holding power generated by the magnetic field between lock parts 12 and 14 alone.

According to a preferred embodiment of the subject invention, the inclined surface 43 extends at an angle of at least approximately 45° to the flat pole face 13, whereby shearing motion is resolved at an angle of 90° so that the lifting force extends substantially parallel to the main magnetic force vector at the pole face 13.

The electromagnetic lock 10 is deenergized and the magnetic field between the lock parts 12 and 14 is thereby removed when it is desired to unlock the door 31. The compliance in the mounting of the striker plate 14, including the elastic coupling 33, permits the striker plate 14 to break clear of the electromagnetic assembly 12 and to come free of the inclined surface 43 and projecting portion of the button 44 at the tapered hole 38. The door 13 and thereby the door opening 27 may thus be opened.

Typically, the electromagnetic lock is deenergized when the door 31 is reclosed and is thereupon reenergized in order to effect electromagnetic locking of the door 31.

In the embodiment illustrated with the aid of FIG. 2, the door structure 27 is of a type having a stop 58 running inside of the doorframe 28, whereby the door 31 is openable or swinging in only one direction.

Figure 7:
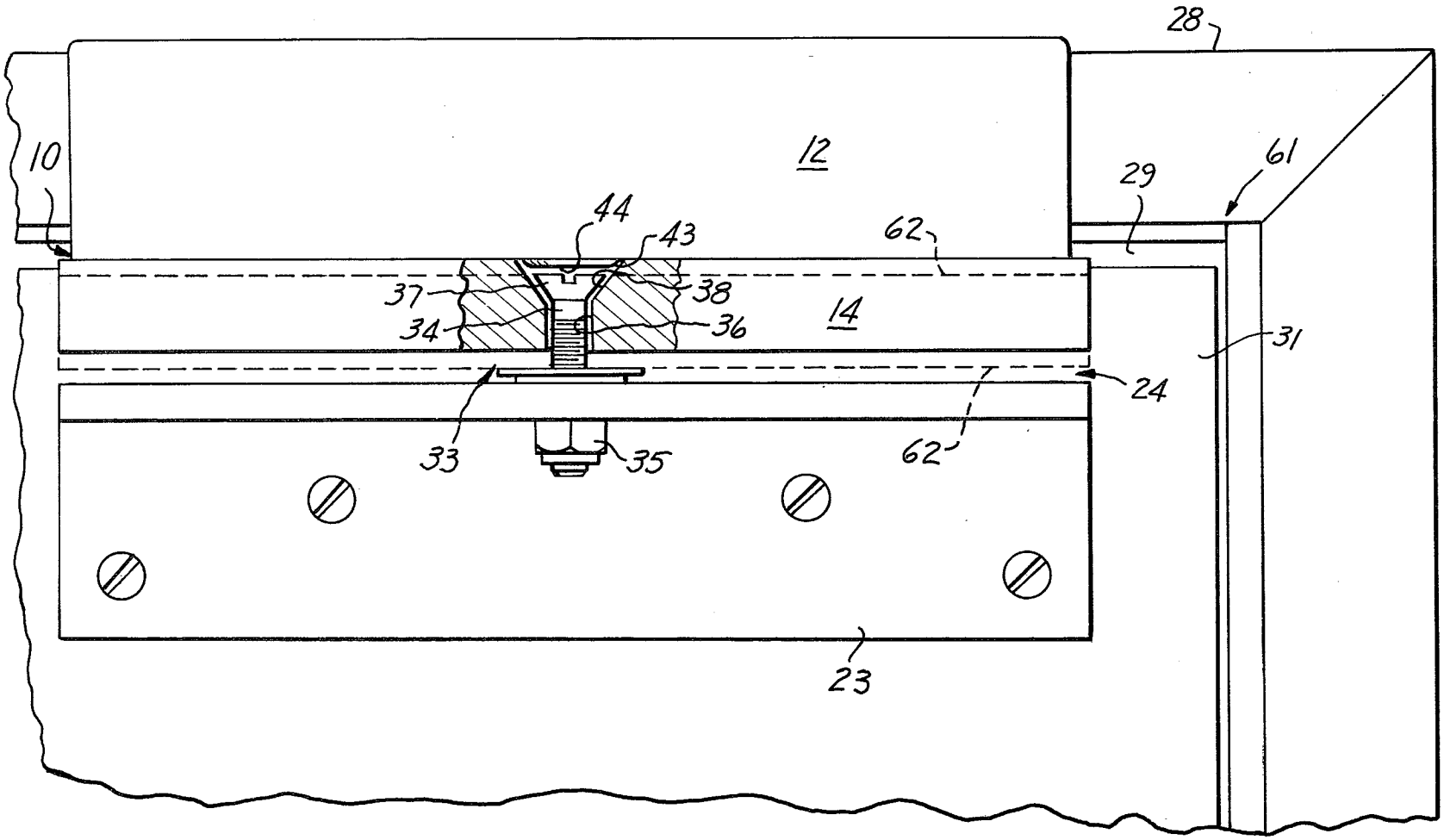
FIG. 7 is part of an elevation of an electromagnetic lock and swinging door structure according to a further embodiment of the subject invention.

By way of further embodiment of the subject invention, FIG. 7 shows part of a door structure 61 designed and mounted for bidirectional swinging motion through the door opening 29.

Apart from this feature, the door structure 61 of FIG. 7 may be similar to the door structure 27 of FIGS. 1 to 6, having a movable part or door 31 swinging bidirectionally through a doorframe 28 defining the door opening 29.

In the case of bidirectionally swinging doors, prior-art electromagnetic locks relying on selective magnetic attraction of a striker plate could not generally be used, at least not without a sacrifice of the desired bidirectional swinging feature.

This drawback is remedied by the subject invention which permits a preservation of the bidirectionally swinging feature of a door structure, in which the door 31 has to be capable of swinging through the door opening 29 and of being securely locked electromagnetically in its mid-position in the doorframe 28.

According to the currently discussed aspect of the subject invention, one of the first and second parts 12 and 14 of the electromagnetic lock 10 is mounted on one of the stationary and movable parts 28 and 31 of the bidirectionally swinging door structure 61, such as shown in FIG. 7, while the other of the first and second parts 12 and 14 of the lock is mounted on the other of the stationary and movable parts 28 and 31 of the bidirectionally swinging door structure 61, to permit the movable part 31 to swing bidirectionally through the door opening 29 in the absence of magnetic attraction in the electromagnetic lock, and to permit the shearing relative motion to be bidirectional between the first and second parts 12 and 14 of the lock 10.

According to the embodiment shown in FIG. 7, the first part or electromagnetic lock assembly 12 is mounted on the doorframe 28. A bracket of the type shown at 23 in FIGS. 2, 3 and 6 may be employed for this purpose. The striker plate assembly 29 may again be attached to the door 31 and its mounting bracket 23 may be employed for this purpose. In the deenergized condition of the lock 10, the striker plate 14 may rest on one of the washers at 33, in a position indicated by a dotted outline 62.

In other words, one of the first and second lock parts, such as the striker plate 14, is spaced from the other of the first and second parts, such as the electromagnetic armature 12, by force of gravity, as indicated in dotted outline 62 in FIG. 7. The mounting bracket 23 and the washers at 33 thereby may act as a means for permitting the striker plate 14 to space itself from the lock assembly 12 by force of gravity.

In that gravity-biased condition, the striker plate 14 misses the projecting disc 44 entirely, so that the door 31 may swing freely through the door opening in either direction.

On the other hand, if it is desired to lock the door 31 in its mid-position inside the frame 28, then the lock assembly 12 is electrically energized, whereby the resulting magnetic field at the pole face 13 will move the striker plate 14 toward the lock assembly 12 by magnetic attraction against the force of gravity.

In this manner, the striker plate 14 assumes its solidly illustrated position shown in FIG. 7, encompassing with its conical bore 38 the inclined surface 43 of the disc 44.

Shearing motion between the first and second parts 12 and 14 of the lock 10 is thus translated at the inclined surface 43 into the above mentioned lifting force upon attempts in either direction of the bidirectional swinging motion to move the movable part of the door structure 61 or to move the door 31 while the first part 12 exert magnetic attraction on the second part 14 of the lock 10. It may be noted in this connection that the so-called "lifting force" in the embodiment of FIG. 7 is a force which attempts to urge the striker plate 14 downwardly so as to separate the striker plate from the electromagnetic lock assembly 12.

According to the embodiment of the invention illustrated in FIG. 7, the mentioned attempts to move the door 31 in either direction of its bidirectional swinging motion are resisted by countering the lifting force developed at the inclined surface 43 with the magnetic attraction of the electromagnetic assembly 12 on the striker plate 14.

Figure 9:
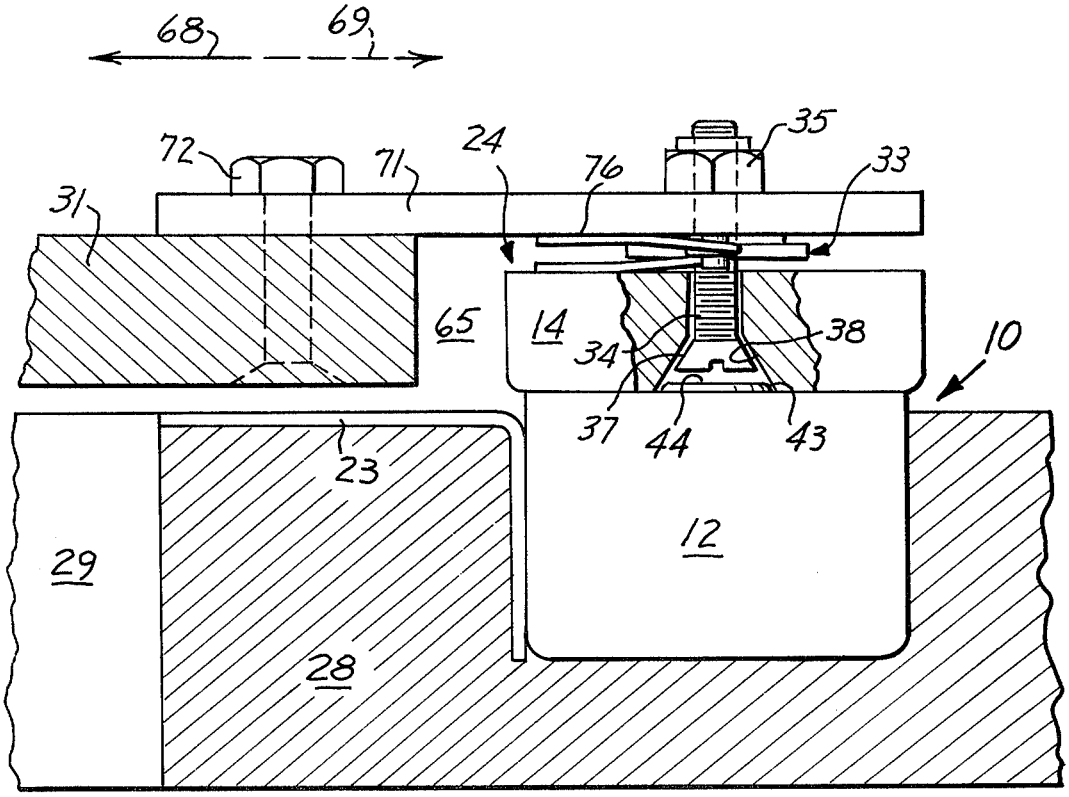
FIG. 9 is part of a top view of an electromagnetic lock and sliding door structure according to a further embodiment of the subject invention.
Figure 8:
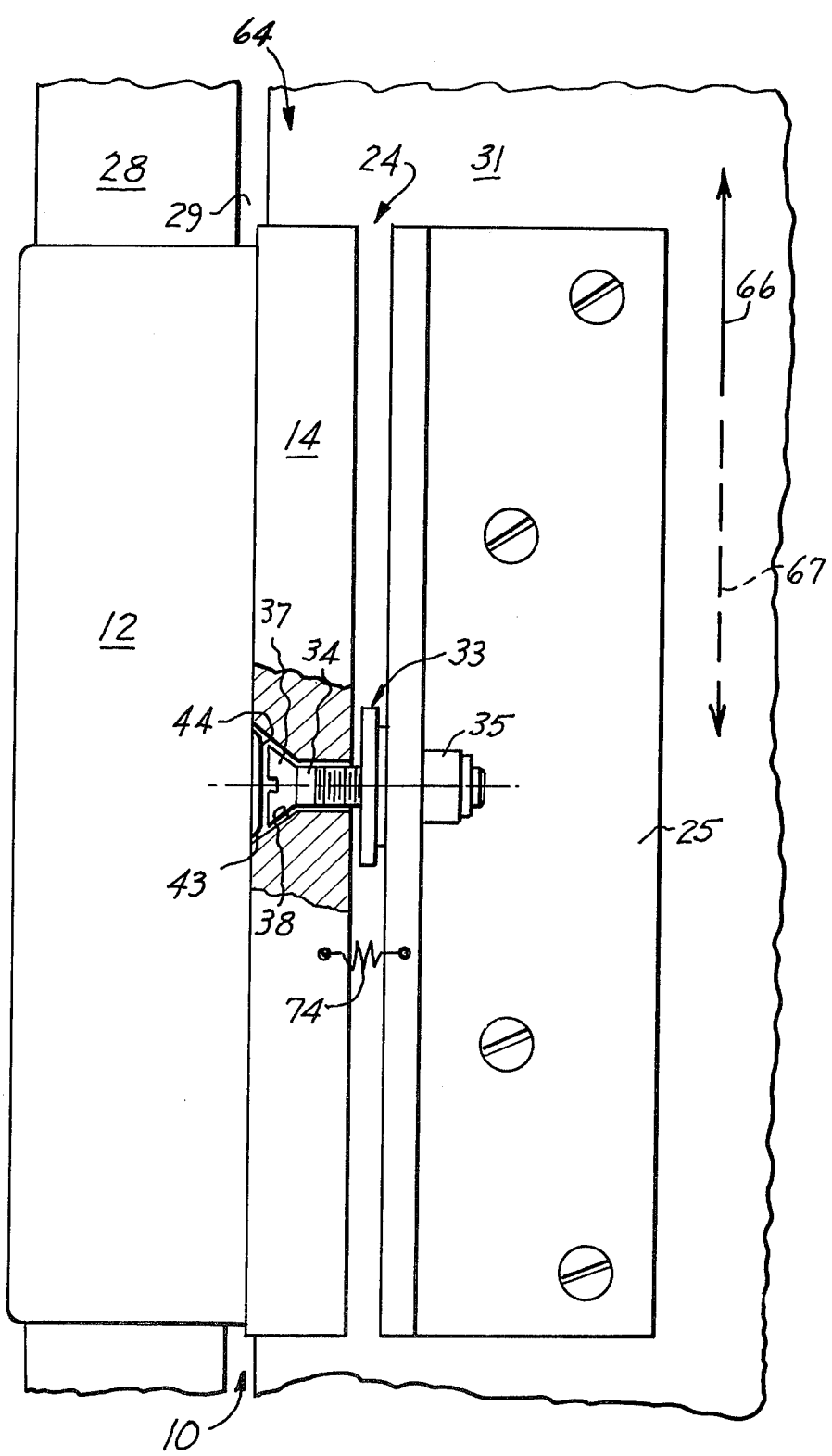
FIG. 8 is part of an elevation of an electromagnetic lock and lifting door structure according to a further embodiment of the subject invention.

FIGS. 8 and 9 illustrate the application of the principles of the subject invention to lifting doors and sliding doors, respectively. In either case, the door 31 is mounted for sliding motion in or at the door opening 29 of the lifting or sliding door structure 64 or 65.

Examples of utility of the door structure 64 partially shown in FIG. 8 include lifting doors for garages and warehouses and for trucks or other vehicles. Examples of utility of the sliding door structure 65 shown in Fig.9 include sliding doors for department stores and supermarkets, as well as other kinds of sliding doors.

As before, one of the first and second parts 12 and 14 of the lock 10, such as the electromagnetic lock assembly 12 is mounted on one of the stationary and movable parts 28 and 31 of the door structure 64 or 65, such as on the doorframe 28, as shown in FIGS. 8 and 9. The other of the first and second parts of the lock, such as the striker plate 14 or striker plate assembly 24, is mounted on the other of the stationary and movable parts of the door structure, such as on the door 31, to permit such movable part 31 to slide in the door opening 29 in the absence of magnetic attraction between the lock parts 12 and 14.

In FIG. 8, opposed arrows 66 and 67 indicate alternative lifting and lowering of the door 31. Similarly, opposed arrows 68 and 69 indicate bidirectional sliding motion of the door 31 in FIG. 9, in the absence of energization of the magnetic lock assembly 12.

If the electromagnetic lock assembly 12 is energized, it attracts the striker plate 14 to its solidly illustrated position shown, for instance, in FIGS. 8 and 9.

Upon sliding motion of the movable part or door 31 in either direction 66 and 67 or 68 or 69, shearing relative motion between the first and second lock parts 12 and 14 occurs. Such shearing motion is translated by the inclined surface 43 at the projection 44 into a lifting force of the above mentioned type. Attempts to slide the movable part 31 of the door structure 64 or 65 are resisted by countering the latter lifting force with the magnetic attraction of the lock assembly 12 on the striker plate 14. In the embodiment shown in FIG. 9, the sliding motion of the door 31 is transmitted to the striker plate 14 by a straight mounting bracket 71 which is attached to the door 31 by fastening means 72.

In practice, various attractive methods of combining the magnetic locking assembly with the door structure may be employed. For instance, as shown in FIG. 9, the electromagnetic locking assembly may be incorporated in the doorframe 28. That method of practically concealing the electromagnetic locking assembly may also be employed in the embodiment of FIGS. 1 to 8. The striker plate 14 or striker plate assembly 74 may then be practically concealed in the door 41.

Upon termination of the magnetic attraction by the lock assembly 12, one of the first and second lock parts is lifted away from the other of such first and second parts by a distance at which the magnetic attraction is capable of attracting such first and second parts toward each other.

A special feature of the locks according to the subject invention is that the striker plate 14 always breaks clear of the pole face 13 when the magnetic assembly 12 is deenergized, thereby forestalling any accidental lock in of people.

For instance, as indicated by way of example in FIG. 7 by the dotted outline 62, the striker plate 14 is lifted away from the lock assembly 12 by a distance at which the magnetic attraction exerted upon energization of the magnetic lock assembly 12 is capable of attracting the striker plate 14 to the magnetic assembly 12 or, in general terms, is capable of attracting the first and second lock parts 12 and 14 toward each other.

These first and second lock parts 12 and 14 may be biased away from each other, such as by force of gravity, as disclosed in connection with FIG. 7, or by a biasing spring, shown at 74 in FIG. 8 as acting between the striker plate 14 and the mounting bracket 25 for biasing the striker plate 14 away from the magnetic lock assembly 12. The resulting spacing of the striker plate 14 from the assembly 12 and the force of the biasing spring 74 are dimensioned so that the magnetic attraction exerted by the energized assembly 12 on the striker plate 14 is sufficient to overcome the bias of the spring 74.

As long as the spring 74 exerts its bias on the striker plate 14 and keeps that striker plate at a distance from the magnetic lock assembly 12 corresponding to the height of the projecting disc 44, the door 31 may be freely moved upwardly and downwardly as indicated by the arrows 66 and 67 in FIG. 8. The bias spring 74 and equivalents thereof, may also be employed in the other embodiments of the subject invention. In this respect, a special form of biasing is shown in FIGS. 1 to 6 and 9.

In particular, the latter biasing addresses itself to an avoidance of mechanical interference and sticking, in case the door 31 should be closed while the electromagnetic locking assembly 12 is in an energized state.

Figure 6:
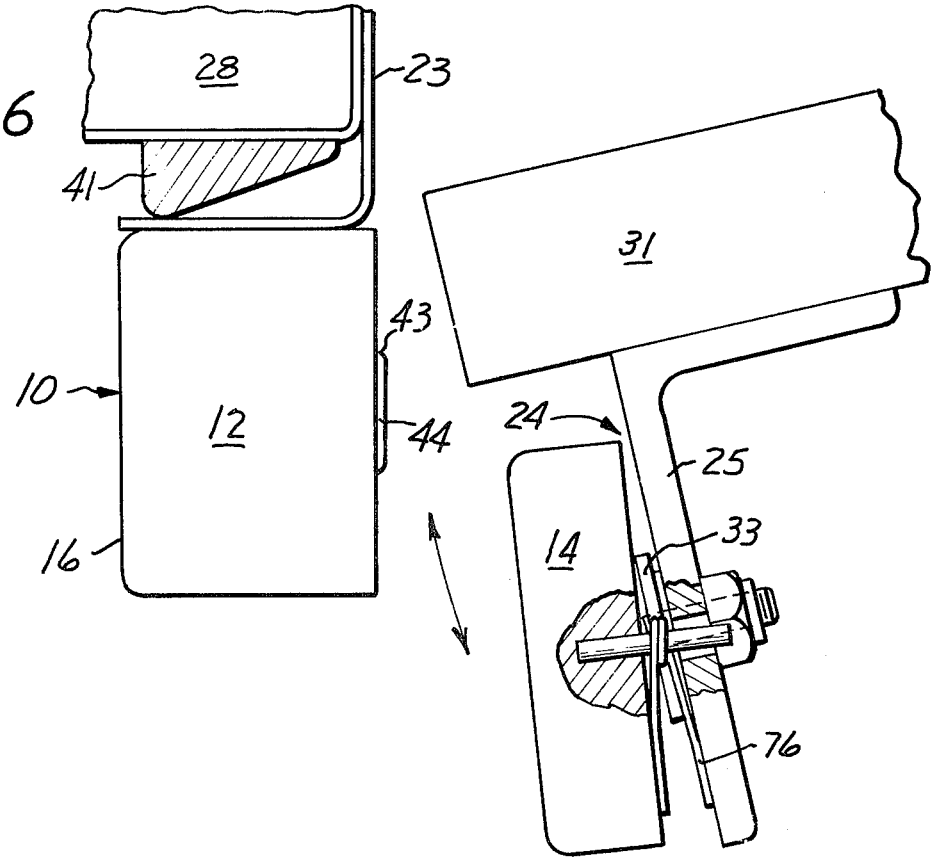
FIG. 6 is a view similar to FIG. 3, showing the electromagnetic lock and door structure in a partially open position.

In particular, the striker plate 14 is tilted, such as in the manner shown in FIG. 6, so that its leading portion can move over the projecting disc 44 when the door 31 is closed. Even if the locking assembly 12 should be energized at that time, the striker plate 14 will cross the pole face 13 at very little force, which may be almost unnoticeable, since the projecting nonmagnetic disc 44 constitutes a large "air gap" or non-magnetic separation as the striker plate 14 slides over the pole face 13. As soon as the countersunk hole 38 in the striker plate 14 has reached the projecting disc 44, the striker plate 14 will be pulled into contact with the pole face 13 and the full holding force will then be developed as the air gap between the pole face 13 and the striker plate 14 diminishes to a minute amount corresponding to the relative flatness of the pole face and striker plate.

Figure 4:
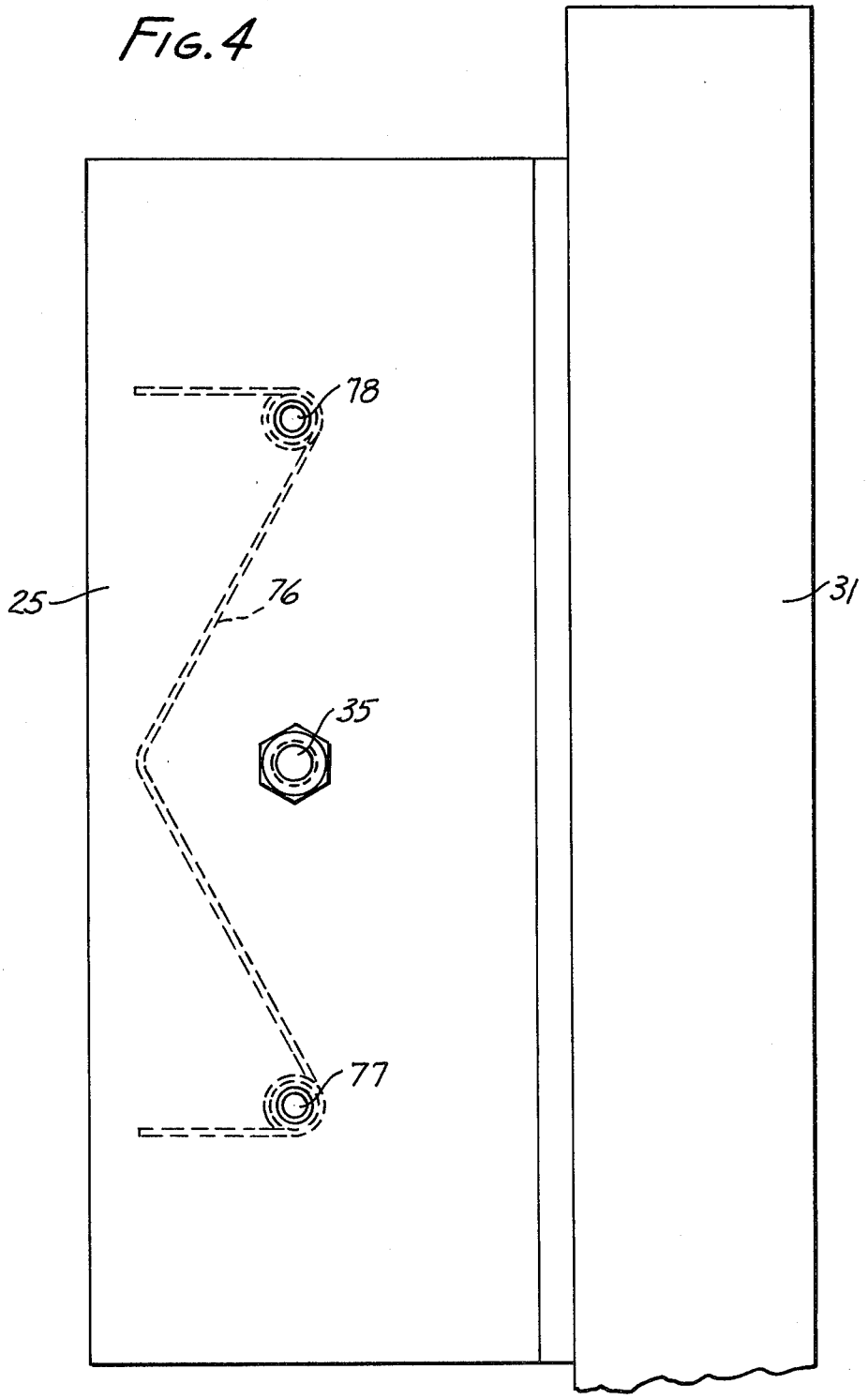
FIG. 4 is a side view of the movable part of the electromagnetic lock and door structure shown in FIG. 1.

As seen in FIG. 6, the desired tilt of the striker plate 14 may be effected by a bias spring which may be shaped as shown in FIGS. 3, 4 and 6, having eyelet portions retained by pins 77 and 78 projecting from the angle bracket 25. A showing of the spring 76 and pins 77 and 78 has been omitted from FIG. 1 in order to avoid any accidental ambiguity therein.

The striker plate tilt effected by action of the spring 76 may also be employed to aid an opening of the door 31 upon deenergization of the magnetic lock assembly 12.

From another aspect thereof, the subject invention may be viewed as providing in one of the first and second lock parts 12 and 14 a protrusion 44 towards the other of such first and second parts, and providing in the other part 14 or 12 a recess 38 corresponding to the protrusion 44. In particular, the drawings show a protrusion 44 projecting from the electromagnetic lock assembly 12 and a corresponding recess 38 provided in the striker plate 14.

The force of gravity in FIG. 7, or the spring 74 in FIG. 8, or the spring 76 in FIGS. 1 to 6 and 9, initially space the first and second lock parts 12 and 14 away from each other by a distance exceeding the protrusion 44 to permit relative sideways motion between the first and second parts 12 and 14, such as during an opening of the door 31. Thereafter, the protrusion 44 and corresponding recess 38 are interfitted by magnetic attraction of movement of the first and second parts 12 and 14 toward each other. In this manner, the electromagnetic assembly and the door 31 connected thereto are securely locked.

When an unlocking of the door 31 is desired, the magnetic attraction of the second part 14 by the first part 12 is terminated, and these first and second parts 12 and 14 are spaced from each other for clearance of the protrusion 44 from the second or other part 14 and relative sideways movement between the first and second parts 12 and 14 during opening of the door 31 in any of the illustrated embodiments of the subject invention.

As explained above with the aid of FIGS. 1 to 6 and 9, one of the first and second parts, such as the striker plate 14 may be tilted relative to the other part, such as the magnetic assembly 12, to clear the protrusion 44 for relative sideways motion between the first and second parts 12 and 14.

According to the illustrated preferred embodiment of the subject invention, the protrusion 44 is, or is made to be, stationary on the particular first or second parts, such as on the magnetic assembly 12 on which it is located. This distinguishes the subject invention from prior-art approaches employing a magnetically actuated relatively movable locking bolt.

The subject extensive disclosure will render apparent or suggest to those skilled in the art various modifications and variations within the spirit and scope of the subject invention.

I claim:

1. In a method of operating an electromagnetic lock including a first part having a magnetic pole face and a second part magnetically attractable to said pole face arranged for shearing relative motion parallel to said pole faec, the improvement comprising in combination the steps of:

exerting magnetic attraction with said first part on said second part by means of a magnetic field generating a predetermined holding power between said first and second parts;

providing with the aid of non-magnetic material a surface inclined relative to said pole face and translating shearing motion between said first and second parts with the aid of said inclined surface into a lifting force tending to lift said second part away from said first part; and providing between side first and second parts a holding power exceeeding said predetermined holding power by countering said lifting force with said magnetic attraction and a mechanical friction between said first and second parts upon attempted shearing motion therebetween.

2. A method as claimed in claim 1, including the steps of:

terminating said magnetic attraction; and lifting one of said first and second parts away from the other of said first and second parts by a distance at which said magnetic attraction is capable of attracting said first and second parts toward each other.

3. A method as claimed in claim 1, including the steps of:

biasing said first and second parts away from each other; and overcoming said biasing by said magnetic attraction.

4. A method as claimed in claim 1, including the steps of:

spacing one of said first and second parts from the other of said first and second parts by force of gravity; and moving said first and second parts toward each other by said magnetic attraction against the force of gravity.

5. A method as claimed in claim 1, 2, 3 or 4, including the steps of:

exerting a force on said inclined surface in response to said shearing motion; and translating said exerted force with said inclined surface into said lifting force.

6. A method as claimed in claim 5, including the steps of:

terminating said magnetic attraction; and tilting one of said first and second parts relative to the other of said first and second parts to clear said inclined surface for relative sideways motion between said first and second parts.

7. In a method of operating an electromagnetic lock including an energizable first part having a magnetic pole face and a second part magnetically attractable to said pole face arranged for shearing relative motion parallel to said pole face, the improvement comprising in combination the steps of:

providing in one of said first and second parts a protrusion toward the other of said first and second parts;

providing in said other part a recess corresponding to said protrusion;

initially spacing said first and second parts away from each other by a distance exceeding said protrusion to permit relative sideways motion between said first and second parts; and interfitting said protrusion and corresponding recess by magnetic attraction upon energization of said first part and movement of said first and second parts toward each other;

constituting said protrusion as a non-magnetic separation between said first and second parts so as to enable said second part to cross said first part even after energization of said first part until said protrusion and corresponding recess are interfitted.

8. A method as claimed in claim 7, including the steps of:

terminating said magnetic attraction; and spacing said first and second parts from each other for clearance of said protrusion by said othere part and relative sideways movement between said first and second parts.

9. A method as claimed in claim 7, including the step of:

terminating said magnetic attraction; and tilting one of said first and second parts relative to the other of said first and second parts to clear said protrusion for relative sideways motion between said first and second parts.

10. A method as claimed in claim 7, 8 or 9, wherein:

said protrusion is made to be stationary on said one of said first and second parts.

11. In a method of operating an electromagnetic lock for a door structure having a stationary part defining a door opening and a movable part for selectively opening and closing said door opening, with said electromagnetic lock including a first part having a magnetic pole face and a second part magnetically attractable to said pole face, the improvement comprising in combination the steps of:

providing with the aid of non-magnetic material a surface inclined relative to said pole face;

mounting one of said first and second parts of said lock on one of said stationary and movable parts of said door structure;

mounting the other of said first and second parts of said lock on the other of said stationary and movable parts of said door structure for shearing relative motion between said first and second parts of said lock parallel to said pole face upon movement of said movable part;

closing said door opening with said movable part of the door structure;

locking said movable part of the door structure in said door opening by exerting magnetic attraction with said first on said second part of the lock by means of a magnetic field generating a predetermined holding power between said first and second parts;

permitting an attempt to move said movable part of the door structure while said first part exerts magnetic attraction on said second part of the lock and translating shearing motion between said first and second parts of the lock with the aid of said inclined surface into a lifting force tending to lift said second part away from said first part of the lock; and resisting said attempt to move said movable part of the door structure by providing between said first and second parts a holding power exceeding said predetermined holding power by countering said shearing motion with an opposition of said lifting force by said magnetic attraction and a mechanical friction between said first and second parts upon attempted shearing motion therebetween.

12. A method as claimed in claim 11, wherein:

said movable part of the door structure is mounted for bidirectional swinging motion through said door opening;

said one of said first and second parts of the lock is mounted on one of said stationary and movable parts of the door structure, and said other of said first and second parts of the lock is mounted on said other of said stationary and movable parts of the door structure to permit said movable part to swing bidirectionally through said door opening in the absence of said magnetic attraction and said shearing relative motion to be bidirectional between said first and second parts of the lock;

shearing motion between said first and second parts of the lock is translated into said lifting force upon attempts in either direction of said bidirectional swinging motion to move said movable part of the door structure while said first part exerts magnetic attraction on said second part of the lock; and said attempts in either direction of said bidirectional swinging motion are resisted by countering said lifting force with said magnetic attraction.

13. A method as claimed in claim 11, wherein:

said movable part of the door structure is mounted for sliding motion in said door opening;

said one of said first and second parts of the lock is mounted on one of said stationary and movable parts of the door structure, and said other of said first and second parts of the lock is mounted on said other of said stationary and movable parts of the door structure to permit said movable part to slide in said door opening in the absence of said magnetic attraction and provide said shearing relative motion upon sliding motion of said movable part in said door opening;

shearing motion between said first and second parts of the lock is translated into said lifting force upon attempts to slide said movable part of the door structure while said first part exerts magnetic attraction on said second part of the lock; and said attempts to slide said movable part of the door structure are resisted by countering said lifting force with said magnetic attraction.

14. A method as claimed in claim 11, 12 or 13, including the steps of:

terminating said magnetic attraction; and lifting one of said first and second parts of the lock away from the other of said first and second parts by a distance at which said magnetic attraction is capable of attracting said first and second parts toward each other.

15. A method as claimed in claim 11, 12 or 13, including the steps of:

biasing said first and second parts of the lock away from each other; and overcoming said biasing by said magnetic attraction.

16. A method as claimed in claim 11, 12 or 13, including the steps of:

spacing one of said first and second parts of the lock from the other of said first and second parts by force of gravity; and moving said first and second parts toward each other by said magnetic attraction against the force of gravity.

17. A method as claimed in claim 11, 12 or 13, including the steps of:

exerting a force on said inclined surface in response to said shearing motion; and translating said exerted force with said inclined surface into said lifting force.

18. A method as claimed in claim 17, including the steps of:

terminating said magnetic attraction; and tilting one of said first and second parts of the lock relative to the other of said first and second parts to clear said inclined surface for relative sideways motion between said first and second parts.

19. In a method of operating an electromagnetic lock for a door structure having a stationary part defining a door opening and a movable part for selectively opening and closing said door opening, with said electromagnetic lock including an energizable first part having a magnetic pole face and a second part magnetically attractable to said pole face, the improvement comprising in combination the steps of:

providing in one of said first and second parts of the lock a protrusion toward the other of said first and second parts;

providing in said other parts of the lock of a recess corresponding to said protrusion;

mounting one of said first and second parts of the lock on one of said stationary and movable parts of the door structure;

mounting the other of said first and second parts of the lock on the other of said stationary and movable parts of the door structure for shearing relative motion between said first and second parts of the lock parallel to said pole face upon movement of said movable part of the door structure;

initially spacing said first and second parts of the lock away from each other by a distance exceeding said protrusion to permit movement of said movable part of the door structure;

locking said movable part of the door structure in said door opening by interfitting said protrusion and corresponding recess by magnetic attraction upon energization of said first part and movement of said first and second parts toward each other; and constituting said protrusion as a non-magnetic separation between said first and second parts so as to enable said second part to cross said first part during closing of said door opening by said movable part even after energization of said first part until said protrusion and corresponding recess are interfitted.

20. A method as claimed in claim 19, wherein:

said movable part of the door structure is mounted for bidirectional swinging motion through said door opening;

said one of said first and second parts of the lock is mounted on one of said stationary and movable parts of the door structure, and said other of said first and second parts of the lock is mounted on said other of said stationary and movable parts of the door structure to permit saidmovable part to swing bidirectionally through said door opening in the absence of said magnetic attraction; and said movable part of the door structure is located in said door opening against movement in either direction of said bidirectional swinging motion by interfitting said protrusion and corresponding recess by said magnetic attraction.

21. A method as claimed in claim 19, wherein:

said movable part of the door structure is mounted for sliding motion in said door opening;

said one of said first and second parts of the lock is mounted on one of said stationary and movable parts of the door structure, and said other of said first and second parts of the lock is mounted on said other of said stationary and movable parts of the door structure to permit said movable part to slide in said door opening in the absence of said magnetic attraction; and said movable part of the door structure is located against said sliding motion by interfitting said protrusion and corresponding recess by said magnetic attraction.

22. A method as claimed in claim 19, 20 or 21, wherein:

said protrusion is made to be stationary on said one of said first and second parts.

23. A method as claimed in claim 22, including the steps of:

terminating said magnetic attraction; and spacing said first and second parts from each other for clearance of said protrusion by said other part and relative sideways movement between said first and second parts of the lock.

24. A method as claimed in claim 22, including the step of:

terminating said magnetic attraction; and tilting one of said first and second parts relative to the other of said first and second parts to clear said protrusion for relative sideways motion between said first and second parts of the lock.

25. In an electromagnetic lock including a first part having a magnetic pole face and a second part magnetically attractable to said pole face by means of a magnetic field generating a predetermined holding power between said first and second parts, said first and second parts being arranged for shearing relative motion parallel to said pole face, the improvement comprising in combination:

non-magnetic means coupled to said first and second parts and having a surface inclined relative to said pole face for translating shearing motion between said first and second parts into a lifting force tending to lift said second part away from said first part; and means for providing between said first and second parts a holding power exceeding said predetermined holding power, including means connected to said first part for magnetically attracting said first and second parts to each other in opposition to said lifting force and for countering said lifting force with said magnetic attraction and a mechanical friction between said first and second parts upon attempted shearing motion therebetween.

26. An electromagnetic lock as claimed in claim 25, including:

means for selectively terminating magnetic attraction between said first and second parts; and means connected to one of said first and second parts for lifting said one part away from the other of said first and second parts upon termination of said magnetic attraction, by a distance at which said first and second parts are magnetically attractable to each other upon restoration of said magnetic attraction.

27. An electromagnetic lock as claimed in claim 25, wherein:

said lock includes means for biasing said first and second parts away from each other; and said magnetically attracting means include means for overcoming said biasing by magnetic attraction.

28. An electromagnetic lock as claimed in claim 25, including:

means coupled to one of said first and second parts for permitting said one part to space itself from the other of said first and second parts by force of gravity; and means connected to said magnetically attracting means for moving said first and second parts toward each other against the force of gravity.

29. An electromagnetic lock as claimed in claim 25, wherein said translating means include:

means for exerting a force on said inclined surface in response to said shearing motion for translation by said inclined surface into said lifting force.

30. An electromagnetic lock as claimed in claim 25, wherein said translating means include:

means for connecting to one of said first and second parts said non-magnetic means having said surface inclined relative to said pole face; and means connected to the other of said first and second parts in response to said shearing motion for translation by said inclined surface into said lifting force.

31. An electromagnetic lock as claimed in claim 29 or 30, including:

means connected to one of said first and second parts for tilting said one part relative to the other of said first and second parts to clear said inclined surface for relative sideways motion between said first and second parts during suspension of said magnetic attraction.

32. An electromagnetic lock as claimed in claim 25, wherein:

said translating means include said non-magnetic means projecting with said inclined surface from one of said first and second parts and means defining a corresponding recess in the other of said first and second parts for jointly translating said shearing motion into said lifting force.

33. In an electromagnetic lock including an energizable first part having a magnetic pole face and a second part magnetically attractable to said pole face arranged for shearing relative motion parallel to said pole face, the improvement comprising in combination:

a protrusion in one of said first and second parts toward the other of said first and second parts;

a recess in said other part corresponding to said protrusion;

means for initially spacing said first and second parts away from each other by a distance exceeding said protrustion to permit relative sideways motion between said first and second parts; and means for interfitting said protrusion and corresponding recess by magnetic attraction upon energization of said first part and movement of said first and second parts toward each other;

said protrusion being of non-magnetic material for enabling said second part to cross said first part even after energization of said first part, until said protrusion and corresponding recess are interfitted.

34. An electromagnetic lock as claimed in claim 33, including:

means for spacing said first and second parts from each other upon cessation of said magnetic attraction for clearance of said protrusion by said other part and relative sideways movement between said first and second parts.

35. An electromagnetic lock as claimed in claim 33, including:

means for tilting one of said first and second parts relative to the other of said first and second parts upon cessation of said magnetic attraction to clear said protrusion for relative sideways motion between said first and second parts.

36. In an electromagnetic lock for a door structure having a stationary part defining a door opening and a movable part for selectively opening and closing said door opening, with said electromagnetic lock including a first part having a magnetic pole face and a second part magnetically attractable to said pole face by means of a magnetic field generating a predetermined holding power between said first and second parts, said first and second parts being arranged for shearing relative motion parallel to said pole face, the improvement comprising in combination:

means for mounting one of said first and second parts of said lock on one of said stationary and movable parts of said door structure;

means for mounting the other of said first and second parts of said lock on the other of said stationary and movable parts of said door structure for shearing relative motion between said first and second parts of said lock parallel to said pole face upon movement of said movable part;

non-magnetic means coupled to said first and second parts of the lock and having a surface inclined relative to said pole face for translating shearing motion between said first and second parts of the lock into a lifting force tending to lift said second part away from said first part of the lock; and means for providing between said first and second parts a holding power exceeding said predetermined holding power, including means connected to said first part for magnetically attracting said first and second parts to each other in opposition to said lifting force and for countering said lifting force with said magnetic attraction and a mechanical friction between said first and second parts upon attempted shearing motion therebetween.

37. An electromagnetic lock as claimed in claim 36, for a door structure in which said movable part is mounted for bidirectional swinging motion through said door opening, wherein:

said means for mounting said one of said first and second parts of the lock and said means for mounting the other of said first and second parts of the lock include means for mounting said one part on one of said stationary and movable parts of the door structure and said other part on said other of said stationary and movable parts of the door structure to permit said movable part to swing bidirectionally through said door opening in the absence of said magnetic attraction and said shearing relative motion to be bidirectional between said first and second parts of the lock; and said translating means include means for translating shearing motion between said first and second parts of the lock into said lifting force upon attempts in either direction of said bidirectional swinging motion to move said movable part of the door structure while said first and second parts magnetically attract each other in opposition to said lifting force.

38. An electromagnetic lock as claimed in claim 36, for a door structure in which said movable part is mounted for sliding motion in said door opening, wherein:

said means for mounting said one of said first and second parts of the lock and said means for mounting the other of said first and second parts of the lock include means for mounting said one part on one of said stationary and movable parts of the door structure and said other part on said other of said stationary and movable parts of the door structure to permit said movable part to slide in said door opening in the absence of said magnetic attraction and provide said shearing relative motion upon sliding motion of said movable part in said door opening; and said translating means include means for translating shearing motion between said first and second parts of the lock into said lifting force upon attempts to slide said movable part of the door structure while said first and second parts magnetically attract each other in opposition to said lifting force.

39. An electromagnetic lock as claimed in claim 36, 37 or 38, including:

means for selectively terminating magnetic attraction between said first and second parts of the lock; and means connected to one of said first and second parts for lifting said one part away from the other of said first and second parts of the lock upon termination of said magnetic attraction, by a distance at which said first and second parts are magnetically attractable to each other upon restoration of said magnetic attraction.

40. An electromagnetic lock as claimed in claim 36, 37 or 38, wherein:

said lock includes means for biasing said first and second parts away from each other; and said magnetically attracting means include means for overcoming said biasing by magnetic attraction.

41. An electromagnetic lock as claimed in claim 36, 37 or 38, including:

means coupled to one of said first and second parts for permitting said one part to space itself from the other of said first and second parts by force of gravity; and means connected to said magnetically attracting means for moving said first and second parts toward each other against the force of gravity.

42. An electromagnetic lock as claimed in claim 36, 37 or 38, wherein said translating means include:

means for exerting a force on said inclined surface in response to said shearing motion for translation by said inclined surface into said lifting force.

43. An electromagnetic lock as claimed in claim 36, 37 or 38, wherein said translating means include:

means for connecting to one of said first and second parts said nonmagnetic means having said surface inclined relative to said pole face; and means connected to the other of said first and second parts for exerting a force on said inclined surface in response to said shearing motion for translation by said inclined surface into said lifting force.

44. An electromagnetic lock as claimed in claim 43, including:

means connected to one of said first and second parts for tilting said one part relative to the other of said first and second parts to clear said inclined surface for relative sideways motion between said first and second parts during suspension of said magnetic attraction.

45. An electromagnetic lock as claimed in claim 36, 37 or 38, wherein:

said translating means include said non-magnetic means projecting with said inclined surface from one of said first and second parts and means defining a corresponding recess in the other of said first and second parts for jointly translating said shearing motion into said lifting force.

46. In an electromagnetic lock for a door structure having a stationary part defining a door opening and a movable part for selectively opening and closing said door opening, with said electromagnetic lock including an energizable first part having a magnetic pole face and a second part magnetically attractable to said pole face, the improvement comprising in combination:

a protrusion in one of said first and second parts of the lock toward the other of said first and second parts;

a recess in said other part of the lock corresponding to said protrusion;

means for mounting one of said first and second parts of the lock on one of said stationary and movable parts of the door structure;

means for mounting the other of said first and second parts of the lock on the other of said stationary and movable parts of the door structure for shearing relative motion between said first and second parts of the lock parallel to said pole face upon movement of said movable part of the door structure;

means for initially spacing said first and second parts of the lock away from each other by a distance exceeding said protrusion to permit movement of said movable part of the door stucture; and means for locking said movable part of the door structure in said door opening by interfitting said protrusion and corresponding recess by magnetic attraction upon energization of said first part and movement of said first and second parts toward each other;

said protursion being of non-magnetic material for enabling said second part to cross said first part even after energization of said first part, until said protrusion and corresponding recess are interfitted.

47. An electromagnetic lock as claimed in claim 46, for a door structure in which said movable part is mounted for bidirectional swinging motion through said door opening, wherein:

said means for mounting said one of said first and second parts of the lock and said means for mounting the other of said first and second parts of the lock include means for mounting said one part on one of said stationary and movable parts of the door structure and said other part on said other of said stationary and movable parts of the door structure to permit said movable part to swing bidirectionally through said door opening in the absence of said magnetic attraction; and said locking means include means for locking said movable part of the door structure in said door opening against movement in either direction of said bidirectional swinging motion by interfitting said protrusion and corresponding recess by said magnetic attraction.

48. An electromagnetic lock as claimed in claim 46, for a door structure in which said movable part is mounted for sliding motion in said door opening, wherein:

said means for mounting said one of said first and second parts of the lock and said means for mounting the other of said first and second parts of the lock include means for mounting said one part on one of said stationary and movable parts of the door structure and said other part on said other of said stationary and movable parts of the door structure to permit said movable part to slide in said door opening in the absence of said magnetic attraction; and said locking means include means for locking said movable part of the door structure against said sliding motion by interfitting said protrusion and corresponding recess by said magnetic attraction.

49. An electromagnetic lock as claimed in claim 46, 47 or 48, wherein:

said protrusion is made to be stationary on said one of said first and second parts.

50. An electromagnetic lock as claimed in claim 49, including:

means for terminating said magnetic attraction; and means for spacing said first and second parts from each other for clearance of said protrusion by said other part and relative sideways movement between said first and second parts of the lock.

51. An electromagnetic lock as claimed in claim 49, including:

means for terminating said magnetic attraction; and means for tilting one of said first and second parts relative to the other of said first and second parts to clear said protrusion for relative sideways motion between said first and second parts of the lock.

52. In a method of operating an electromagnetic lock including a first part having a magnetic pole face and a second part magnetically attractable to said pole face arranged for shearing relative motion parallel to said pole face, the improvement comprising in combination the steps of:

providing in one of said first and second parts a protrusion toward the other of said first and second parts;

making said protrusion to be stationary on said one of said first and second parts;

providing in said other part a recess corresponding to said protrusion;

initially spacing said first and second parts away from each other by a distance exceeding said protrusion to permit relative sideways motion between said first and second parts;

interfitting said protrusion and corresponding recess by magnetic attraction and movement of said first and second parts toward each other;

terminating said magnetic attraction; and tilting one of said first and second parts relative to the other of said first and second parts to clear said protrusion for relative sideways motion between said first and second parts.

53. A method as claimed in claim 7, including the step of:

providing said protrusion with a flat top.

54. A method as claimed in claim 19, including the step of:

providing said protrusion with a flat top.

55. An electromagnetic lock as claimed in claim 32, wherein:

said means projecting from one of said first and second parts have a flat top.

56. An electromagnetic lock as claimed in claim 32, wherein:

said means projecting from one of said first and second parts constitute a non-magnetic separation between said first and second parts for enabling second part to cross said first part even after an energization of said first part until said projecting means and corresponding recess are interfitted.

57. An electromagnetic lock as claimed in claim 56, wherein:

said means projecting from one of said first and second part have a flat top.

58. An electromagnetic lock as claimed in claim 33, wherein:

said protrusion of non-magnetic material has a flat top.

59. An electromagnetic lock as claimed in claim 36, wherein:

said translating means include non-magnetic means projecting from one of said first and second parts and means defining a corresponding recess in the other of said first and second parts for jointly translating said shearing motion into said lifting force and for providing a non-magnetic separation between said first and second parts so as to enable said second part to cross said first part even after energization of said first part, until said protrusion and corresponding recess are interfitted.

60. An electromagnetic lock as claimed in claim 59, wherein:

said means projecting from one of said first and second parts have a flat top.

61. An electromagnetic lock as claimed in claim 46, wherein:

said protrusion of non-magnetic material has a flat top.

* * * * *